US007561841B2

(12) United States Patent
Callis et al.

(10) Patent No.: US 7,561,841 B2
(45) Date of Patent: Jul. 14, 2009

(54) CLEANING SYSTEM FOR A FUSER APPARATUS

(75) Inventors: Martin Callis, Hemel Hempstead (GB); Riley Brede, Welwyn Garden City (GB); Pieter Mulder, Welwyn Garden City (GB); John Poxon, Stevenage (GB); Ian Pitts, Bassingbourn (GB); Nicholas Baxter, Welwyn Garden City (GB)

(73) Assignee: Xerox Corporation, Norwalk, CT (US)

( * ) Notice: Subject to any disclaimer, the term of this patent is extended or adjusted under 35 U.S.C. 154(b) by 205 days.

(21) Appl. No.: 11/314,686

(22) Filed: Dec. 21, 2005

(65) Prior Publication Data

US 2007/0140756 A1 Jun. 21, 2007

(51) Int. Cl.
*G03G 15/20* (2006.01)

(52) U.S. Cl. ..... 399/327; 399/326; 399/353

(58) Field of Classification Search ..... 399/327, 399/71, 122, 320, 321, 326, 353, 346
See application file for complete search history.

(56) References Cited

U.S. PATENT DOCUMENTS

| | | | | |
|---|---|---|---|---|
| 3,706,108 | A * | 12/1972 | Taylor | 15/1.51 |
| 3,831,553 | A | 8/1974 | Thettu | |
| 3,883,292 | A * | 5/1975 | Hamaker | 432/60 |
| 4,040,383 | A | 8/1977 | Vandervort | |
| 4,899,197 | A * | 2/1990 | Davis et al. | 399/326 |
| 5,253,025 | A | 10/1993 | Mitsuya et al. | |
| 5,356,473 | A | 10/1994 | Fromm | |
| 5,534,986 | A | 7/1996 | Irro et al. | |
| 5,597,413 | A | 1/1997 | Kromm, Jr. | |
| 5,674,020 | A | 10/1997 | Kimura et al. | |
| 5,678,153 | A * | 10/1997 | Okamoto et al. | 399/327 |
| 6,143,675 | A | 11/2000 | McCollam et al. | |
| 6,378,161 | B1 | 4/2002 | Parry | |
| 6,970,670 | B2 * | 11/2005 | Konishi et al. | 399/167 |
| 2003/0210934 | A1 * | 11/2003 | Matsumoto | 399/324 |

FOREIGN PATENT DOCUMENTS

| | | | |
|---|---|---|---|
| EP | 0 479 564 B1 | | 12/1995 |
| JP | 04152380 A | * | 5/1992 |
| JP | 2005326510 A | * | 11/2005 |
| WO | WO 02/096573 | | 12/2002 |

OTHER PUBLICATIONS

Deguchi, Masanobu, Machine Translation of JP 2005326510 A, Nov. 24, 2005.*

* cited by examiner

*Primary Examiner*—David M Gray
*Assistant Examiner*—Laura K Roth
(74) *Attorney, Agent, or Firm*—Fay Sharpe LLP

(57) ABSTRACT

A fuser apparatus includes first and second rolls rotatably mounted parallel to and in contact with each other to form a nip through which print media with a toner image thereon is passed to fuse the image to the print media. A cleaning system is provided for cleaning one of the rolls, such as the fuser roll. The cleaning system includes a rotatably mounted cleaning roll, an outer surface thereof including a pile. A flicker bar is arranged to detach toner from the pile.

19 Claims, 6 Drawing Sheets

CLEANING SYSTEM FOR A FUSER APPARATUS

BACKGROUND

The present exemplary embodiment relates to a cleaning system and, more particularly, to a device for use in a fuser apparatus of an electrophotographic marking device for cleaning the fuser roll of toner particles.

In typical electrophotographic image forming devices, such as copy machines and laser beam printers, a photoconductive insulating member is charged to a uniform potential and thereafter exposed to a light image of an original document to be reproduced. The exposure discharges the photoconductive insulating surface in exposed or background areas and creates an electrostatic latent image on the member, which corresponds to the image areas contained within the document. Subsequently, the electrostatic latent image on the photoconductive insulating surface is made visible by developing the image with a marking material. Generally, the marking material comprises pigmented toner particles adhering triboelectrically to carrier granules, which is often referred to simply as toner. The developed image is subsequently transferred to the print medium, such as a sheet of paper. The fusing of the toner image onto paper is generally accomplished by applying heat and pressure. A typical fuser apparatus includes a fuser roll and a pressure roll which define a nip therebetween. The side of the paper having the toner image typically faces the fuser roll, which is often supplied with a heat source, such as a resistance heater, at the core thereof. The combination of heat from the fuser roll and pressure between the fuser roll and the pressure roll fuses the toner image to the paper, and once the fused toner cools, the image is permanently fixed to the paper.

Some toners adhere well to paper but do not adhere well to themselves. Included among these are toners where the particles are small in dimension, relative to the size of the nip. As a result, they may not receive sufficient compressive force to sinter well. This can lead to adherence of significant quantities of unsintered toner particles to the fuser roll. Some toners are more prone to fuser roll contamination than others. The extra toner tends to accumulate on the stripper fingers, which serve to release the fused image from the fuser roll, and on the temperature sensors. From here, the toner can be retransferred to the paper in the form of small clumps that create visible image quality defects.

Fuser assemblies typically include a cleaning system by which the fuser roll can be automatically cleaned and/or supplied with a lubricant or release agent. In some cleaning devices, a cloth web is urged against the surface of the fuser roll at a location generally away from the nip formed by the pressure and fuser rolls. Other systems include a rotating oil-filed roller with a layer of permeable material, which slowly releases the oil on to the fuser roll and absorbs excess toner therefrom. In some cases, the toner can build up on the cleaning system and be retransferred as clumps to the fuser roll, to be deposited on a subsequent sheet. This can cause visible defects in the printed copies. Spots and strings of toner can also be deposited on the stripper fingers and temperature sensors of the fuser apparatus. The toner can also be transferred to the pressure roll, particularly after a pause in printing when rotation of the pressure and fuser rolls is recommenced.

The toner is transferred from the pressure roll to the back side of the first copy and leads a user to request a servicing of the printer.

INCORPORATION BY REFERENCE

The following references, the disclosures of which are incorporated herein in their entireties by reference, are mentioned:

U.S. Pat. No. 6,378,161 to Parry discloses a cleaning element for use in the fuser section of an electrostatic reproduction apparatus or printer. The cleaning element includes a perforated oil-filled cylinder and an outer fabric layer including fibers, which project from the outer surface to form a pile.

U.S. Pat. No. 3,831,553 to Thettu discloses an apparatus for lubricating a heated fuser roll. The apparatus includes an applicator roll in contact with an oil supply and a wick, which contacts the fuser roll.

U.S. Pat. No. 5,674,020 to Kimura, et al. discloses an oil coating roller composed of a coating fluid holding member comprising a porous hollow cylindrical molded body impregnated with a coating fluid, such as silicone oil. A felt fabricated of heat-resistant fiber is wound around the outer surface to discloses a design of an applicator for applying a coating fluid, such as a lubricant, to a roller.

U.S. Pat. No. 5,534,986 to Irro, et al. discloses an oil metering device for a fuser roll which includes an exchangeable applicator roller mounted on a carrier tube.

BRIEF DESCRIPTION

Aspects of the exemplary embodiment disclosed herein relate to a cleaning system, to a fuser apparatus incorporating a lubrication device, and to a method of removing toner from a fuser roll.

In one aspect, a fuser apparatus includes first and second rolls rotatably mounted parallel to an in contact with each other to form a nip through which print media with a toner image thereon is passed to fuse the image to the print media. The fuser apparatus also includes a cleaning system for cleaning one of the rolls. The cleaning system includes a rotatably mounted cleaning roll, an outer surface thereof comprising a pile, and a flicker bar arranged to detach toner from the pile.

In another aspect, a method for removing toner from a fuser first roll includes contacting the fuser first roll with a cleaning roll to detach loose toner from the fuser roll, an outer surface of the cleaning roll comprising a pile. The cleaning roll is contacted with a flicker bar to detach toner from the cleaning roll. The flicker bar contacts fibers of the pile to detach the loose toner therefrom.

In another aspect, a cleaning system for an associated rotatable roll includes a rotatably mounted cleaning roll, an outer surface thereof comprising a pile. A drive member drives the cleaning roll so as to rotate the cleaning roll about a longitudinal axis thereof. A flicker bar contacts the pile. The flicker bar includes a first end arranged to detach toner from the pile, and has a second end remote from cleaning roll. The flicker bar includes a plate which extends generally parallel with the longitudinal axis of the cleaning roll. A biasing member engages the second end of the flicker bar such that the first end is biased into contact with the pile.

DETAILED DESCRIPTION

Aspects of the exemplary embodiment relate to a cleaning system for a rotating cylindrical roll, such as the heater roll of a fuser apparatus. The cleaning system includes a rotatable cleaning member with a pile on its outer surface. The pile collects loose toner particles and/or other unwanted loose material from the surface of the cylindrical roll as it rotates. A flicker bar, positioned adjacent the cleaning member, engages the pile and flicks off loose toner particles before they agglomerate into large lumps. As they are generally too small to be visible to the naked eye, the fine particles can be flicked onto print media passing by the flicker bar without deleteriously affecting the print quality. Alternatively, a catch tray may be positioned to collect toner particles that have been flicked off the cleaning member by the flicker bar. The flicker bar may also fluff the pile, which can become squashed as it contacts the heated roll. The cleaning member may serve to deliver a lubricant onto the heated roll from a reservoir in the cleaning member's interior.

Figure 1:
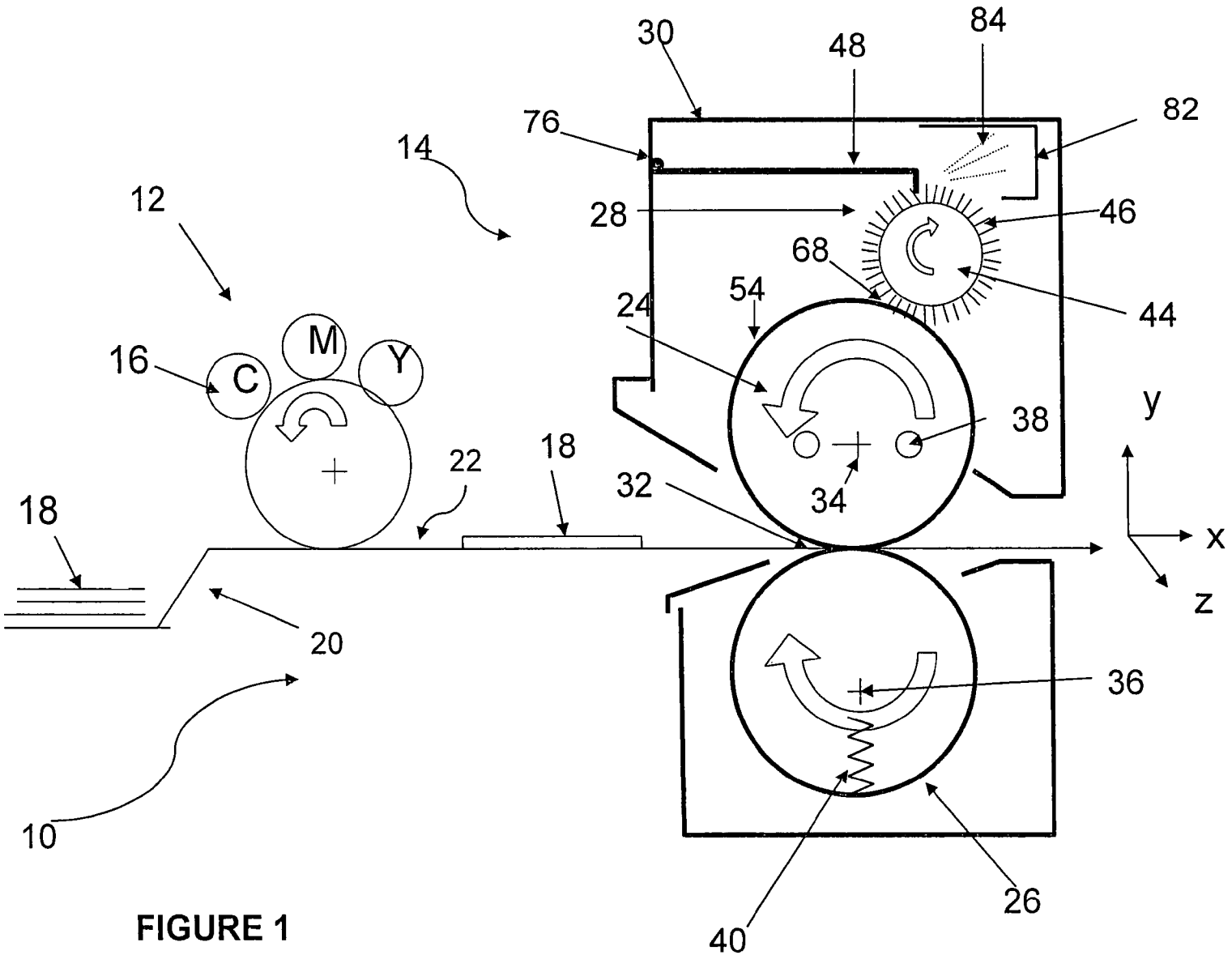
FIG. 1 is a schematic view of a printing system according to one aspect of the exemplary embodiment which incorporates a fuser roll cleaning system.

With reference to FIG. 1, an electrophotographic printing system 10 includes an image applying component 12, which applies a toner image to print media by the steps of latent image formation, development, and transfer, and a fusing system 14, which fuses the applied image to the print media. The image applying component 12 includes one or more toner sources 16, such as cyan, magenta, and yellow (C, M, and Y) in the illustrated embodiment, and may employ conventional xerographic techniques, as know in the art. Print media 18 is conveyed to the image applying component 12 from a print media source 20, such as one or more trays, by a conveyor system 22. The conveyor system 22 also transports print media with toner images thereon from the image applying component 12 to the fusing system 14 in the processing direction, indicated by arrow x. The exemplary printing system 10 may include a variety of other components, such as finishers, paper feeders, and the like, and may be embodied as a copier, printer, bookmaking machine, facsimile machine, or a multifunction machine.

"Print media" can be a usually flimsy physical sheet of paper, plastic, or other suitable physical print media substrate for images. A "print job" or "document" is normally a set of related sheets, usually one or more collated copy sets copied from a set of original print job sheets or electronic document page images, from a particular user, or otherwise related. An image generally may include information in electronic form which is to be rendered on the print media by the marking engine and may include text, graphics, pictures, and the like. A "finisher" can be any post-printing accessory device, such as a tray or trays, sorter, mailbox, inserter, interposer, folder, stapler, stacker, hole puncher, collater, stitcher, binder, envelope stuffer, postage machine, or the like. The operation of applying images to print media, for example, graphics, text, photographs, etc., is generally referred to herein as printing or marking.

The fusing system 14 (or simply "fuser") generally includes first and second tangentially rotating rolls, namely a fuser roll 24 and a pressure roll 26, and a cleaning system 28. The fuser roll 24 and pressure roll 26 are rotatably mounted in a fuser housing 30 and are aligned parallel to and in contact with each other to form a nip 32 through which the print media, such as paper 18, with a toner image thereon (not shown) is passed, as in the direction of arrow x. The fuser roll and pressure roll are rotated about respective axes of symmetry 34, 36 aligned generally perpendicular with the process direction, in the direction of arrow z. The fuser roll 24 is heated by a heating system 38, illustrated as a pair of heat lamps aligned parallel to the axis 34 of the fuser roll 24. A drive system rotates the fuser and pressure rolls 24, 26 in the directions shown in FIG. 1. For example, the fuser roll 24 may be driven at about 300 mm per second. The pressure roll 26 is urged into contact with the fuser roll 24 by a constant spring force, indicated by arrow 40.

The fuser roll 24 may include a rigid cylindrical sleeve, formed from aluminum or other suitable metal, that is hollow and has a wall thickness about 5 mm, or less. The pressure roll 26 may include a cylindrical conformable roll, which includes a metal core, such as steel, with a layer of silicone rubber or other conformable material on its outer surface that is covered by a conductive heat resistant material, such as Teflon™. As the paper with the toner image is passed through the nip 32, the toner image melts and is permanently fused to the paper 18. Mechanical stripper fingers (not shown), downstream of the nip 32, ensure that the paper with the permanent image is prevented from sticking to the fuser roll 16 and is transported through the nip 32.

The cleaning system 28 includes a rotatable cleaning member in the form of a cylindrical cleaning roll 44, which contacts one of the first and second rolls, 24, 26 at a location spaced from the nip 32. The contacted roll is the heated fuser roll 24 in the illustrated embodiment and will be described as such in the following description, although it is to be appreciated that the description could apply analogously to the pressure roll 26. The cleaning roll 44 includes a pile 46, which forms an outer surface of the roll. A flicker bar 48 engages the cleaning roll 44 and dislodges toner from the pile 46.

Figure 2:
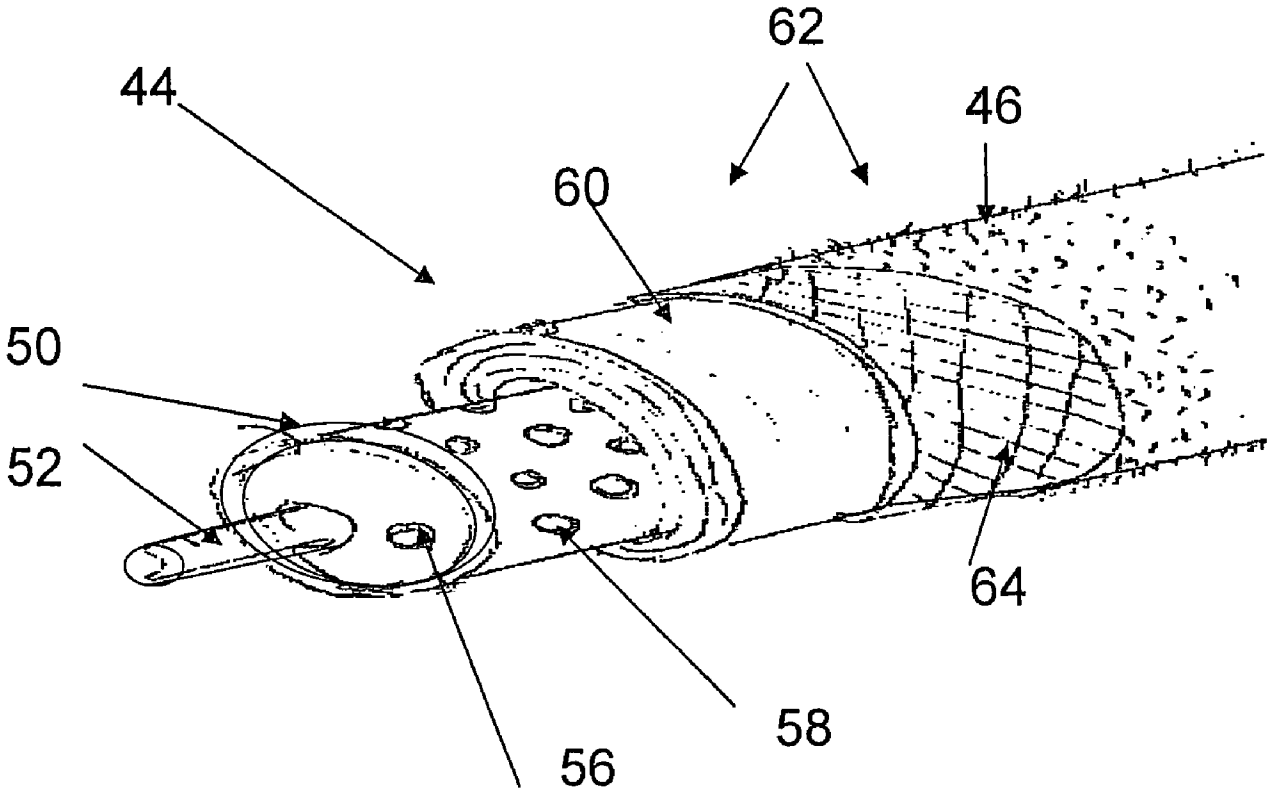
FIG. 2 is a perspective view, in partial section, of the cleaning system of FIG. 1.

With reference to FIG. 2, which shows one embodiment of the cleaning roll 44, the roll 44 includes a reservoir 50 in the form of a perforated cylinder. The cylinder 50 may be formed from aluminum or other suitable metal or other material and is carried for rotation on an axially mounted spindle 52 at one or both ends thereof. The cylinder 50 is capped at ends thereof and is filled with a supply of lubricant. The lubricant can be any liquid material which is applied in a thin coat to a surface 54 of the fuser roll 24 (FIG. 1) for whatever purpose, such as a silicone oil, optionally combined with suitable release agents. Silicone oil is used to increase adherence of toner particles to the cleaning member 44 and to reduce any damage caused by the cleaning roll as a result of abrasion. The function of the release agent is to prevent sheets of paper that pass through the fuser nip from sticking to the surface of the fuser roll, thus causing a paper jam.

The oil or other lubricant in the cylinder 50 may be replenished intermittently via a fill port 56 or may be continuously replenished from a supply tank (not shown) via a hose, in the manner described in U.S. Pat. No. 5,534,986 to Irro, et al., incorporated herein by reference. As the cleaning member 44 rotates, apertures 58 in the cylinder 50 release the oil into an oil-permeable material 60, such as paper or cloth, which may be wound around the cylinder 50 or carried on a removable support tube, as described in above-mentioned U.S. Pat. No. 5,534,986.

The oil-permeable material 60 is covered by a an outer fabric layer 62 which comprises a woven or non-woven substrate 64, such as cloth or felt, having a pile 46 of fibers, projecting therefrom. The fibers forming the pile 46 can be natural or synthetic fibers. In one embodiment, the pile comprises a cut pile of depth in range 0.5-20 mm, e.g., 1-5 mm, although a looped or partially looped pile may be used. The fibers of the pile may have a uniform, generally circular cross section, or have multi-lobal cross-section, as described, for example, in above-mentioned U.S. Pat. No. 6,378,161 to Parry, which is incorporated herein by reference. In one embodiment, the fibers include synthetic fibers, which are resistant to thermal breakdown at temperatures up to 250° C. or higher, although natural fibers, such as wool or cotton, or combinations of fiber forming materials may be used. Suitable fibers include polyimide, PTFE, PPS or a mixture thereof. It is also contemplated that different zones of the cleaning member may be provided with different fibers and/or that some portions of the cleaning element surface may be free of fibers. The fibers may have a denier in the range 0.5-20 denier, in one embodiment, 0.5-15 denier, such as about 5 denier, and are flexible. The fibers may have a packing density of at least 20 fibers/cm$^2$, and in one embodiment, at least 100 fibers/cm$^2$. The various layers 60, 62, can be bonded together through any known process, such as by adhesive, hot-melting, or any combination of such techniques. Alternatively, one or more layers may be in the form of a removable sleeve or be otherwise mounted on the preceding layer.

Figure 3:
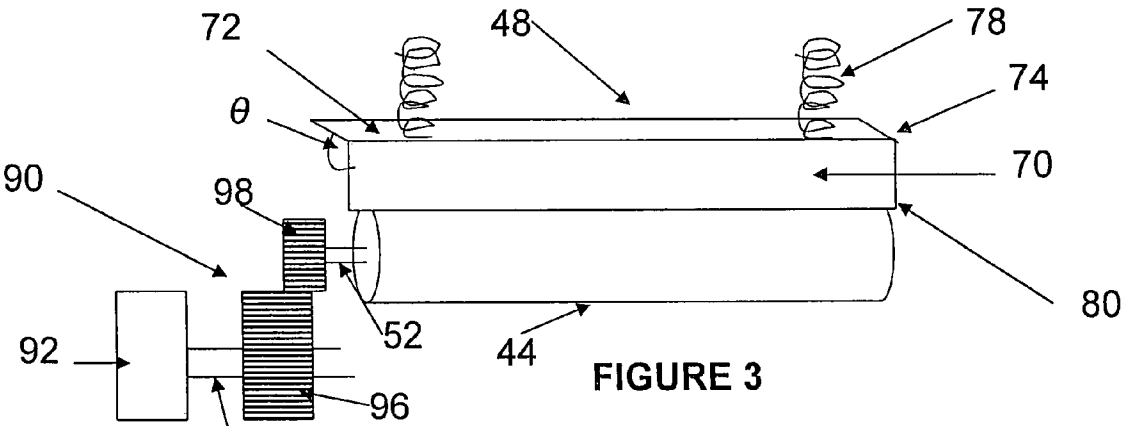
FIG. 3 is an enlarged perspective view of a first embodiment of the cleaning system of FIG. 1.

With reference once more to FIG. 1, and with reference also to FIG. 3, the cleaning member 44 engages the fuser roll to define a nip 68 therebetween. The cleaning member 44 can be rotated at a lower speed than the fuser roll 24 and in the same direction such that the fibers 46 wipe toner particles from the fuser roll. The toner particles catch on the fibers and are carried thereon, as the cleaning member rotates, to the flicker bar 48, which is spaced from the nip 68. For example, the fuser roll may be driven at about 300 mm per second, while the cleaning member is driven at about 200 to 280 mm per second in the same direction, or at any speed in an opposite direction.

The flicker bar 48 or at least a distal portion thereof, can be formed of any semi-resilient material, such as metal or plastic, and which serves to prevent the pile of felt in felt layer 62 from flattening. It is desirable that the pile 46 be kept fairly "fluffed," thus maximizing the surface area of the pile against the fuser roll 24. FIG. 3 shows one embodiment of a flicker bar in the form of an L-shaped plate. By L-shaped it is meant that a distal first portion 70 of the plate is angled to a second portion 72, which is remote from the cleaning roll 44, to create a hinge 74. The angle θ between the portions 70, 72 can be from about 60° to about 120°, e.g., 90° in the illustrated embodiment. The flicker bar 48 can be mounted at an end 76 of the second portion, for example, to the housing 30 of the fuser apparatus 14 or other rigid support surface. The end 76 may be rigidly attached to the housing 30 or hinged thereto so that it is free to pivot. As shown in FIG. 3, the second portion 72 is spring biased towards the cleaning roll 44 by a biasing member 78, such as one or more springs. Alternatively, the biasing member 78 comprises a weight or weights which provide a constant load on the second portion 72.

The plate from which the flicker bar is formed may be about 2 mm thick or less between its major surfaces, to define a narrow edge at the free end 80. In one embodiment, the flicker bar 46 is integrally formed, by bending a plate along the line of the hinge 74. In other embodiment, the first and second portions 70, 72 may be separately formed and welded or otherwise joined together. In the illustrated embodiment, the first portion 70 is arranged generally perpendicular to the surface of the cleaning roll, although other orientations are contemplated.

As the cleaning roll 44 rotates, a free end 80 of the first portion 70 flexes relative to the second portion 72 due to a slight engagement with the fibers of the pile 46, thereby creating a spring force. The spring force is intermittently released, flicking any loose toner which has collected on the fibers 46 or on the flicker bar 48 away from the cleaning roll 44. In one embodiment, the loose toner may be allowed to fall onto the substrate 18. In another embodiment, the loose toner may be collected in a catch tray 82 suitably positioned to catch a significant portion of the flicked toner particles 84 (FIG. 1).

In one embodiment, the cleaning member 44 is mechanically driven. This helps to prevent the cleaning member from stalling due to the drag of the flicker bar 48 and the friction caused by the oil load on the pile 46. Various methods for driving the cleaning roll are contemplated. By way of example, FIG. 3 illustrates the cleaning roll 44 as being driven by a drive system 90 comprising a motor 92 which also drives the fuser roll. For example, the motor drives a drive shaft 94 which is connected to the fuser roll. A gear 96 mounted to the drive shaft 94 engages a second gear 98 on the cleaning member shaft. The ratio of the gears is selected to provide relative movement between the cleaning roll 44 and the fuser roll 24. Alternatively, the cleaning roll 44 may have a separate drive system.

Figure 4:
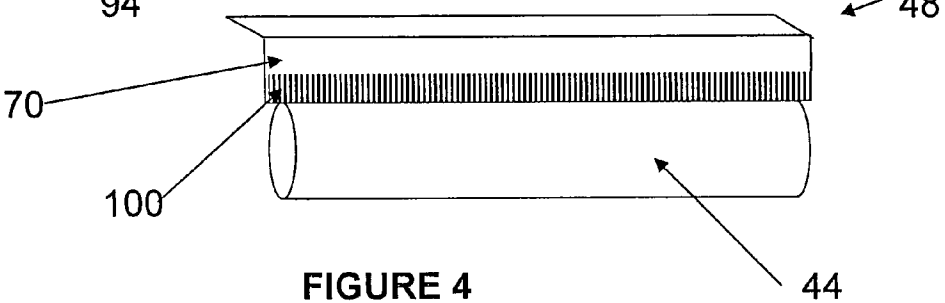
FIG. 4 is an enlarged perspective view of a second embodiment of the cleaning system of FIG. 1.
Figure 5:
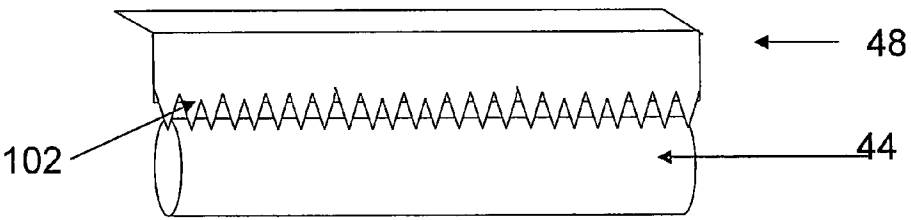
FIG. 5 is an enlarged perspective view of a third embodiment of the cleaning system of FIG. 1.
Figure 6:
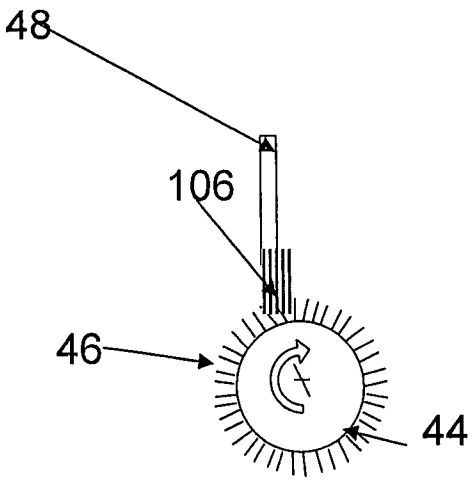
FIG. 6 is an enlarged side view of a fourth embodiment of the cleaning system of FIG. 1.
Figure 7:
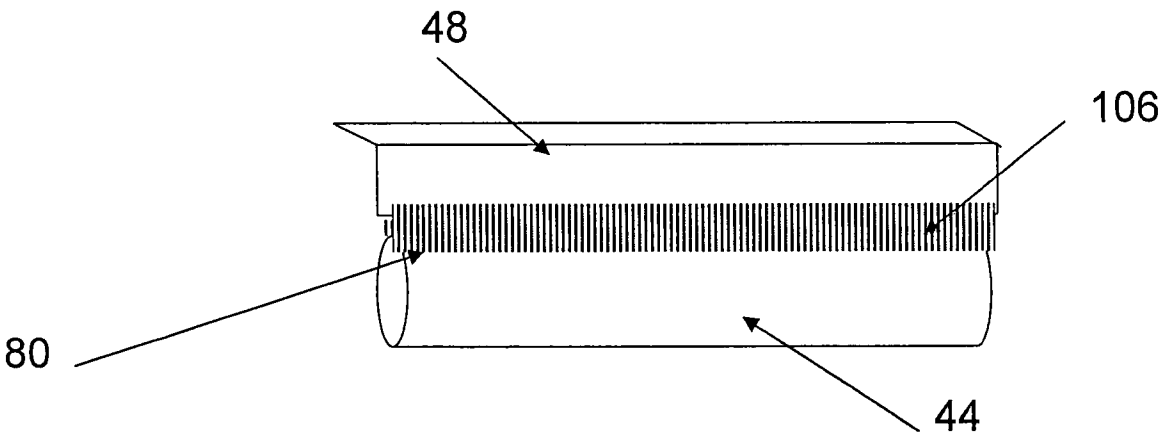
FIG. 7 is a perspective view the cleaning system of FIG. 6.

The flicker bar 48 of FIG. 3 has a straight free end similar to a knife edge. In other embodiments, the free end 80 of the first portion may be profiled, e.g., include teeth 100 (FIG. 4) and/or serrations 102 (FIG. 5). The teeth 100 or serrations 102 can flex and flick somewhat independently of their neighbors. In yet another embodiment, which is particularly suited to coarser, shorter, and/or more rigid fibers 46, the free end 80 of the flicker bar includes bristles 106, as shown in FIGS. 6 and 7. The bristles may be arranged in two or more rows. A profiled edge may be beneficial for a pile 46 which is made of longer and/or thicker strands, whereas a straight edge may be more effective on a shorter and/or stiffer pile.

Figure 8:
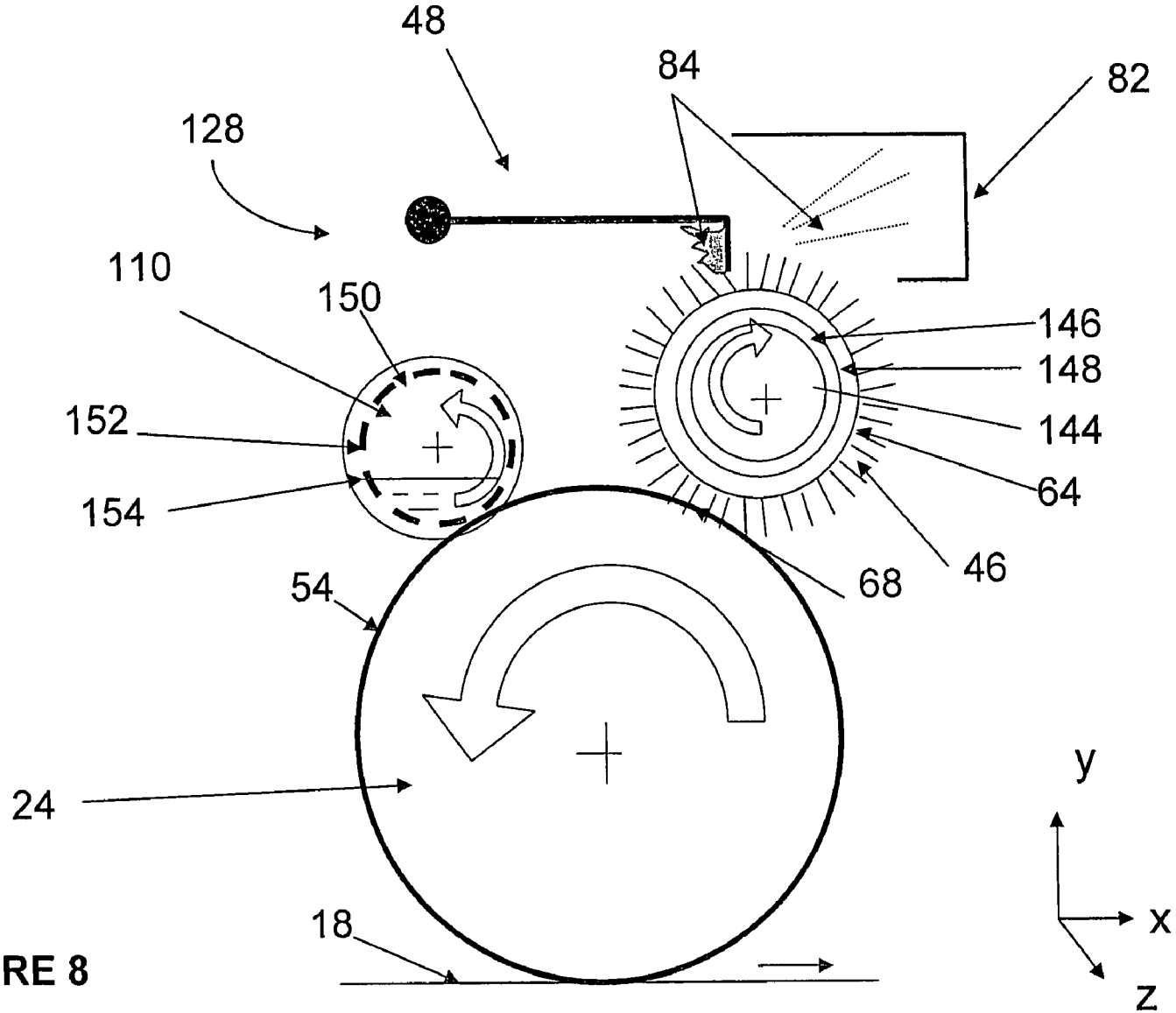
FIG. 8 is a schematic view of a fifth embodiment of a cleaning system suited to use with the fusing system of FIG. 1.

FIG. 8 shows another embodiment of a cleaning system 128, which may be similarly configured to the cleaning system 28 of FIGS. 1-7, except as otherwise noted. In this embodiment, a lubrication roll 110, spaced from the nip 68 contacts the fuser roll 24 (or the pressure roll). Oil or other lubricant from the oil roll is applied to the surface of the fuser roll. The lubrication roll 110 may be driven or may be rotated by the rotating action of the fuser roll 24. In the illustrated embodiment, a cleaning roll 144 contacts the fuser roll before the oil roll 110, removing toner from the fuser roll surface 54 and thus leaving a clean surface for receiving the oil. During operation of the fuser apparatus 14, some of the oil is transferred by the fuser roll 24 onto the cleaning roll surface. The cleaning roll 144 may be similarly configured to the cleaning roll 44, with the oil reservoir 50 and lubrication permeable material 60 being omitted. For example, the cleaning roll may comprise a cylinder 146, such as a rigid metal cylinder, optionally with a conformable layer 148, such a silicone rubber thereon, to which the substrate 64 and pile 46 are attached. The oil roll 110 may be configured similarly to cleaning roll 44, except in that the pile 46 may be omitted. In the illustrated embodiment, the oil roll includes a reservoir 150 similar to reservoir 50 with apertures 152 through which oil is released into an oil-permeable layer 154. A mechanical drive system, analogous to drive system 90 of FIG. 3, may be used to drive the cleaning member.

Figure 9:
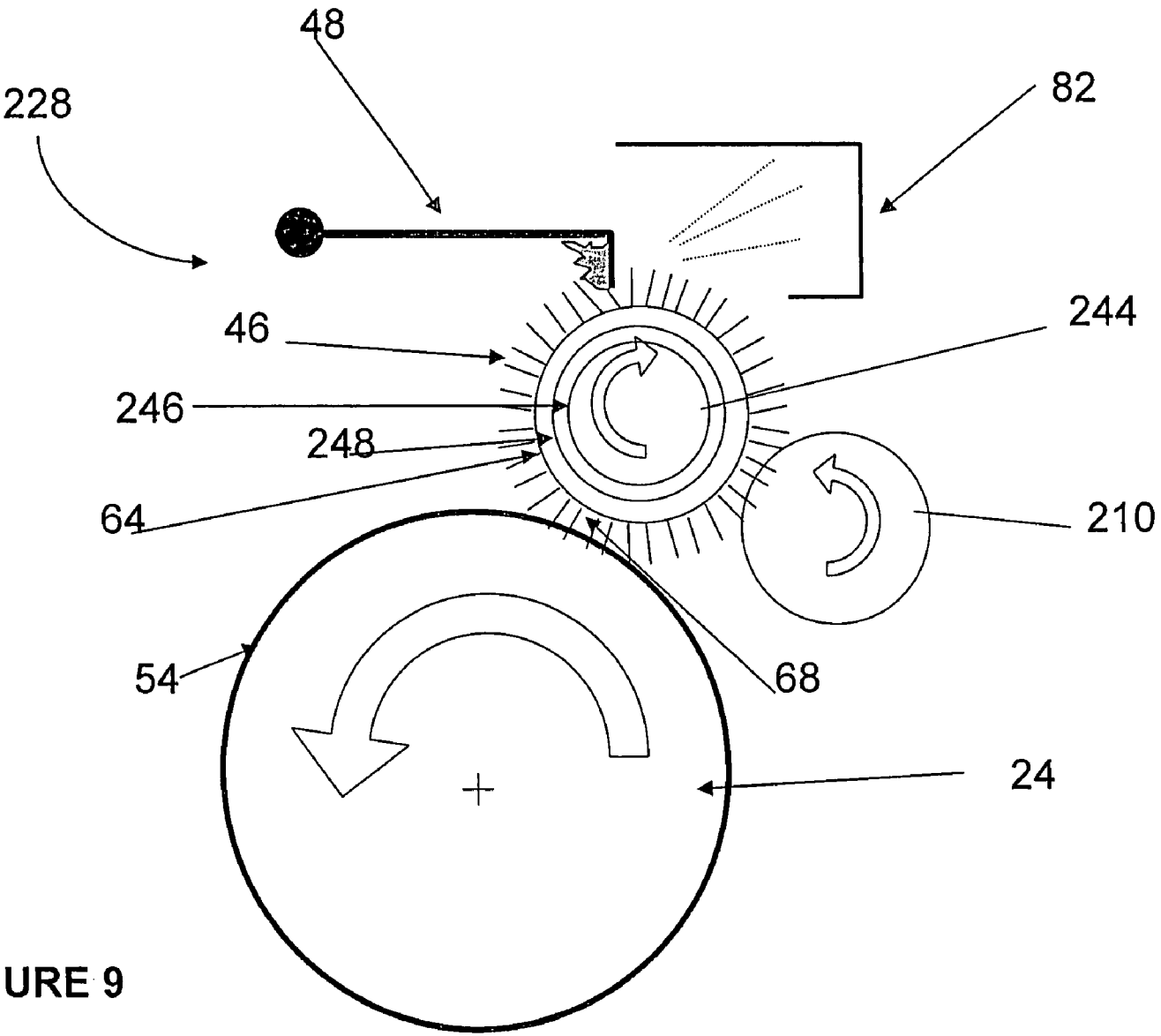
FIG. 9 is a schematic view of a sixth embodiment of a cleaning system suited to use with the fusing system of FIG. 1.

FIG. 9 shows yet another embodiment of a cleaning system 228, which may be similarly configured to the cleaning systems 28, 128 of FIGS. 1-8, except as otherwise noted. In this embodiment, a lubrication roll 210, spaced away from the fuser roll 24 contacts a cleaning roll 244. Cleaning roll 244 and lubricating roll 210 may be similarly configured to the rolls 144, 110 of FIG. 7, although in this case, the cleaning roll 244 serves to transfer oil from the oil roll 210 onto the fuser roll surface. Oil or other lubricant from the oil roll is applied to the surface of the fuser roll. The lubrication roll 110 may be driven or may be rotated by the rotating action of the fuser roll 24 and/or cleaning roll 244. During operation of the fuser apparatus 14, some of the oil is transferred to the cleaning roll 244 and from there to the fuser roll surface 54. The cleaning roll 244 may be similarly configured to the cleaning roll 44, 144 with the oil reservoir 50 and lubrication permeable material 60 being omitted. For example, the cleaning roll may comprise a cylinder 246, such as a rigid metal cylinder, optionally with a conformable layer 248, such a silicone rubber thereon, to which the substrate 64 and pile 46 are attached.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A fuser apparatus comprising:

first and second rolls rotatably mounted parallel to and in contact with each other to form a nip through which print media with a toner image thereon is passed to fuse the image to the print media;

a cleaning system for cleaning one of the rolls, the cleaning system comprising:

a rotatably mounted cleaning roll, an outer surface thereof comprising a pile;

a flicker bar arranged to detach toner from the pile, the flicker bar including a resiliently flexible member which flexes as it contacts the pile; and a spring biasing member which spring-biases the resiliently flexible member into contact with the pile.

2. The fuser apparatus of claim 1, wherein the resiliently flexible member comprises a plurality of projections.

3. The fuser apparatus of claim 2, wherein the projections comprise at least one of the group consisting of serrations, teeth, and bristles.

4. The fuser apparatus of claim 1, wherein the flicker bar comprises a plate which contacts the pile, the plate extending generally parallel with a longitudinal axis of the cleaning roll.

5. The fuser apparatus of claim 1, wherein the cleaning roll comprises a lubricant reservoir which delivers lubricant to the pile.

6. The fuser apparatus of claim 5, wherein the cleaning roll further comprises a lubricant permeable material intermediate the reservoir and the pile.

7. The fuser apparatus of claim 1, further comprising a lubricant roll comprising a lubricant reservoir for supplying a lubricant to the first roll, the lubricant roll having a longitudinal axis spaced from a longitudinal axis of the cleaning roll, the lubricant roll and the cleaning roll directly contacting the first roll.

8. The fuser apparatus of claim 7, wherein the lubricant roll contacts the first roll at a location spaced from the cleaning roll.

9. The fuser apparatus of claim 1, further comprising a catch tray which collects toner detached from the cleaning roll by the flicker bar.

10. The fuser apparatus of claim 1, wherein the first roll is a heated roll and the second roll is a pressure roll which is biased into contact with the heated roll.

11. A xerographic printing system comprising the fuser apparatus of claim 1.

12. A fuser apparatus comprising:

first and second rolls rotatably mounted parallel to and in contact with each other to form a nip through which print media with a toner image thereon is passed to fuse the image to the print media;

a cleaning system for cleaning one of the rolls, the cleaning system comprising:

a rotatably mounted cleaning roll, an outer surface thereof comprising a pile; and a flicker bar arranged to detach toner from the pile, the flicker bar comprising a plate which extends generally parallel with a longitudinal axis of the cleaning roll, the plate having a first end remote from the cleaning roll, the plate being pivotable mounted at the first end so that during operation, it is free to pivot.

13. The fuser apparatus of claim 12, further comprising a drive member which drives the cleaning roll.

14. A printing system comprising the fuser apparatus of claim 12.

15. A fuser apparatus comprising:

first and second rolls rotatably mounted parallel to and in contact with each other to form a nip through which print media with a toner image thereon is passed to fuse the image to the print media;

a cleaning system for cleaning one of the rolls, the cleaning system comprising:

a rotatably mounted cleaning roll, an outer surface thereof comprising a pile; and a flicker bar arranged to detach toner from the pile, the flicker bar comprising:

an L-shaped plate which contacts the pile, the plate extending generally parallel with a longitudinal axis of the cleaning roll; and a biasing member which biases the plate into contact with the pile.

16. The fuser apparatus of claim 15, wherein the flicker bar includes a resiliently flexible member which flexes as it contacts the pile.

17. A printing system comprising the fuser apparatus of claim 15.

18. A cleaning system for an associated rotatable roll comprising:

a rotatably mounted cleaning roll, an outer surface thereof comprising a pile;

a drive member which drives the cleaning roll so as to rotate the cleaning roll about a longitudinal axis thereof; and a flicker bar which contacts the pile, the flicker bar comprising a first end arranged to detach toner from the pile, and having a second end remote from cleaning roll, the flicker bar comprising a plate with first and second major surfaces and an edge which extends generally parallel with the longitudinal axis of the cleaning roll; and a biasing member which engages the first major surface at a second end of the flicker bar such that the first end is biased into contact with the pile.

19. A printing system comprising the cleaning system of claim 18.

* * * * *